US005556322A

United States Patent [19]

Ford

[11] Patent Number: 5,556,322

[45] Date of Patent: Sep. 17, 1996

[54] PNEUMATIC MECHANISM FOR THE APPLICATION OF UNIFORM PRESSURE TO A MECHANICALLY ADJUSTABLE SPINDLE

[75] Inventor: Ronald N. Ford, Lockport, Ill.

[73] Assignee: Sommer & Maca Industries, Inc., Chicago, Ill.

[21] Appl. No.: 523,226

[22] Filed: Sep. 5, 1995

[51] Int. Cl.[6] ..... B24B 49/00

[52] U.S. Cl. ..... 451/21; 451/24

[58] Field of Search ..... 451/22, 24, 26, 451/21, 481; 125/11.23

[56] References Cited

U.S. PATENT DOCUMENTS

| | | | |
|---|---|---|---|
| 2,521,668 | 9/1950 | Price | 451/24 |
| 4,248,019 | 2/1981 | Hawley et al. | 451/26 |
| 4,368,596 | 1/1983 | Wada et al. | 451/24 |
| 4,731,954 | 3/1988 | Lilienfein | 451/22 |
| 4,926,604 | 5/1990 | Hara et al. | 451/22 |
| 5,119,599 | 6/1992 | Klipper et al. | 451/24 |
| 5,197,230 | 3/1993 | Simpfendorfer et al. | 451/21 |

*Primary Examiner*—Bruce M. Kisliuk
*Assistant Examiner*—Andrew Weinberg
*Attorney, Agent, or Firm*—Dorn, McEachran, Jambor & Keating

[57] ABSTRACT

A pneumatic mechanism for the application of uniform pressure to a mechanically adjustable spindle. The mechanism includes a support shelf with a double-acting piston attached at its non-pressure end to the support shaft. A cylinder receives the piston for telescopingly sliding movement of the piston relative to the cylinder. A lifting stop rod is connected to the pressure end of the piston and an externally threaded tube engages the pressure end of the piston and telescopingly receives the lifting stop rod. A worm wheel engages the threaded tube and a worm gear engages the worm wheel. A hand wheel is connected to the worm gear for rotating the worm gear and the worm wheel. An adjustable connection is provided between the lifting stop rod and the threaded tube permitting limited stop movement of the lifting stop rod by the piston relative to the threaded tube. Air ports for directing pressurized air against the bottom end of the piston to lift the piston and the lifting stop rod relative to the threaded tube and against the upper end of the piston to return the piston to its lowered position are provided in the cylinder.

3 Claims, 2 Drawing Sheets

PNEUMATIC MECHANISM FOR THE APPLICATION OF UNIFORM PRESSURE TO A MECHANICALLY ADJUSTABLE SPINDLE

BACKGROUND AND SUMMARY OF THE INVENTION

The conventional, manually adjustable spindle has been used to support motor driven polishing wheels in polishing contact with materials such as glass. While such a spindle can be finely adjusted by its hand wheel so as to position the polishing wheel against the surface of the material to be polished, it will not remain in adjustment as the polishing wheel wears. Thus, to maintain a constant polishing pressure against the material being polished, it has been necessary for the operator to continuously adjust the lifting spindle by operation of the hand wheel. This requires both skill and attention by an operator to achieve a desired result of a uniform polishing.

This invention is directed to a pneumatically adjustable mechanism incorporated into a manually adjustable lifting spindle of a power driven polishing wheel which permits the application of a constant lifting pressure to a polishing wheel throughout a limited distance which will compensate for any wear of the polishing wheel.

An object of this invention is a manually adjustable spindle having a pneumatically applied constant pressure stroke.

Another object of this invention is a manually adjustable spindle to which a constant lifting pressure can be applied across the entire range of mechanical adjustment of the spindle.

A further object of this invention is a mechanically adjustable spindle having a pneumatically applied constant pressure stroke, the length of which stroke can be readily adjusted.

Other objects of the invention may be found in the following specification, claims and drawings.

BRIEF DESCRIPTION OF THE DRAWINGS

The invention is shown more or less diagrammatically in the following drawings wherein.

DESCRIPTION OF THE PREFERRED EMBODIMENT

Figures 1, 3:
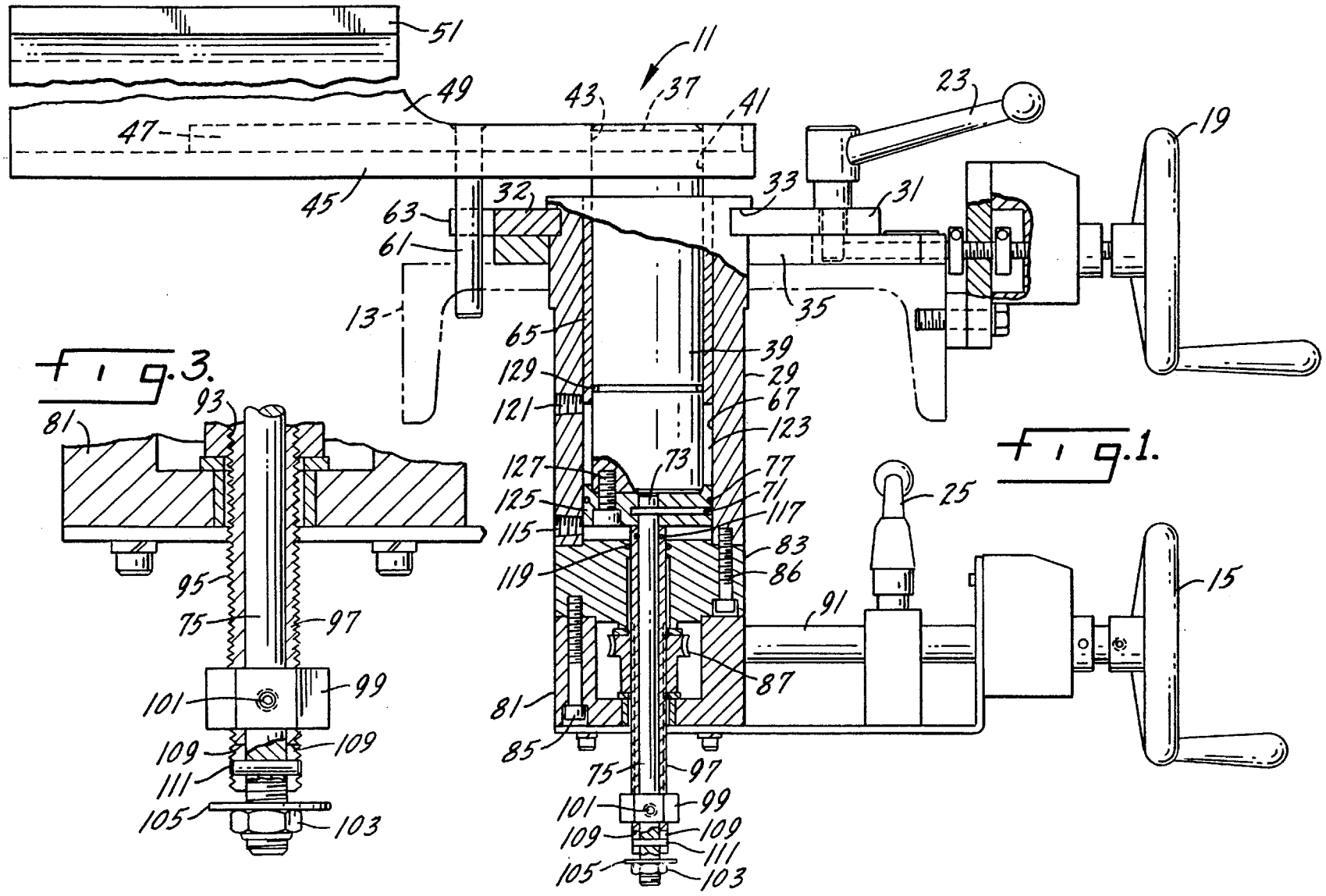
FIG. 1 is a partial side elevational view of the spindle of this invention with some parts broken away, some environment defining parts shown in phantom lines, some hidden parts shown in dashed lines and some parts shown in cross section.
FIG. 3 is an enlarged, partial cross sectional view of the spindle of FIG. 1.

The drawings depict a manually adjustable spindle 11 mounted on an inverted channel shaped base 13 shown in phantom lines. Vertical adjustment of the spindle is accomplished by a hand wheel 15. Horizontal adjustment of the spindle 11 is provided by a hand wheel 19 with a clamp handle 21 provided to lock the spindle in its horizontally adjusted position. A clamp handle 23 locks the spindle in a selected position of horizontal rotation and a clamp handle 25 locks the hand wheel 15 in a selected position of vertical adjustment. The parts of the mechanism heretofore described are found in commercially available manually adjustable spindles.

An air cylinder 29 is supported on rotatable wedge shaped plates 31 and 32 mounted diametrically oppositely to each other in an outwardly opening annular groove 33 formed in the cylinder 29 which groove receives the edges of the plates. The rotatable plates 31 and 32 are mounted on a slidable plate 35. The upper end 37 of a double-acting piston 39 is seated in openings 41 and 43 formed in a shelf 45 and a shelf base plate 47. The shelf 45 includes a tubular portion 49 at one end on which is mounted a polisher motor base plate 51. A rotation stop pin 61 extends downwardly from the shelf 45 into a slot 63 formed in the rotatable plate 32 so that the shelf rotates with the cylinder and plates 31 and 32.

A sleeve 65 is seated in the upper portion of a cylindrical passage 67 of the cylinder 29 providing a bearing surface for the piston 39. A cross pin 71 connects the upper end 73 of a lifting stop rod 75 to the lower end of the piston 39. An air seal ring 77 is positioned in an annular notch formed in the piston near its lower end.

Figure 2:
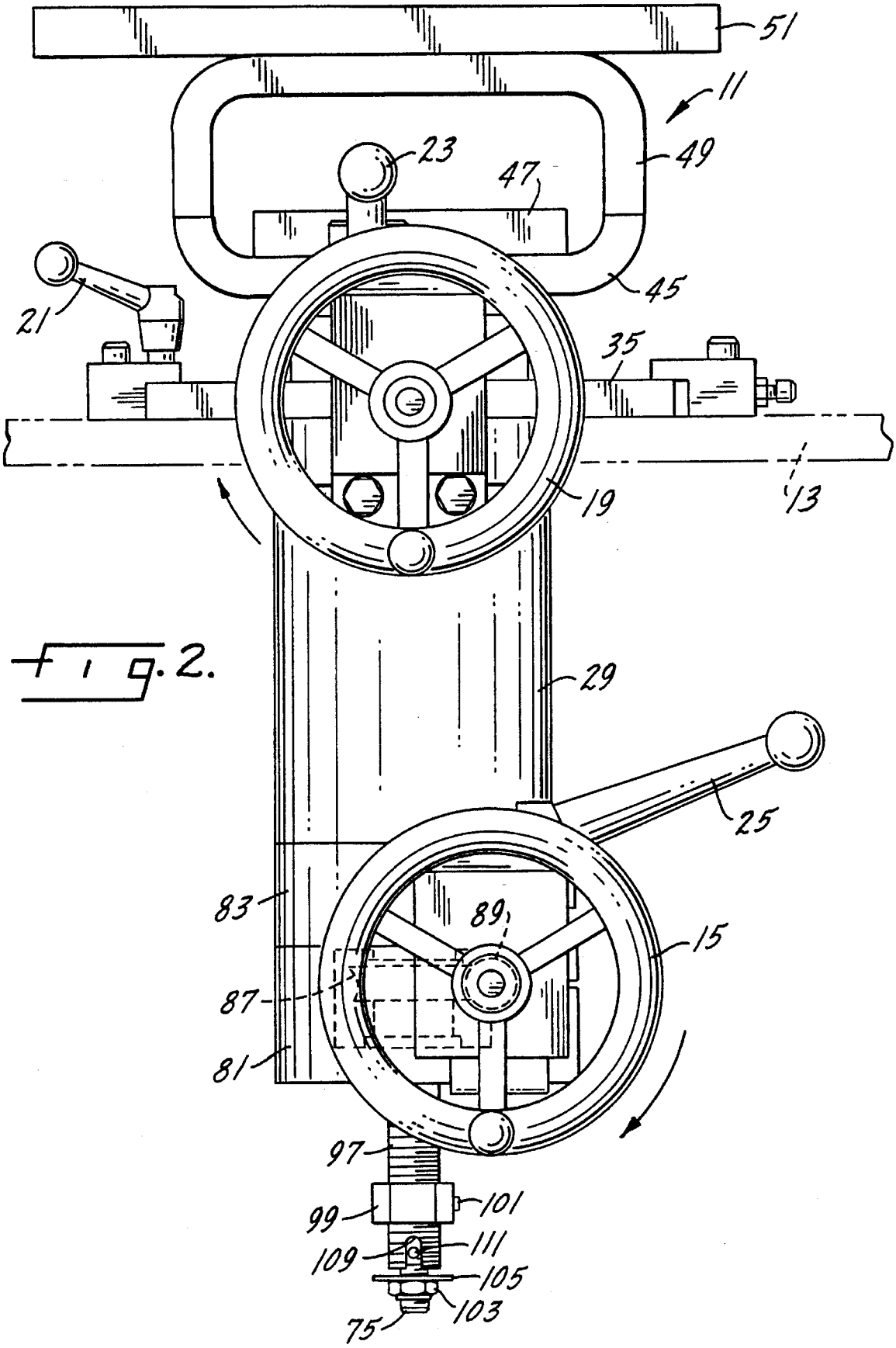
FIG. 2 is a front elevational view on a slightly enlarged scale of the spindle of FIG. 1 with some environment defining parts shown in phantom lines and some hidden parts shown in dashed lines.

A cylindrical gear housing 81 is separated from the bottom of the cylinder 29 by a partition plate 83 with the gear housing being attached to the partition plate by bolts 85 and the partition plate 83 being fastened to the cylinder by bolts 86. A worm wheel assembly 87 is located inside the gear housing 81. The worm wheel assembly includes a worm gear 89, shown most clearly in FIG. 2 of the drawings, which is mounted on a shaft 91 connected to hand wheel 15. The inside threads 93 of the worm wheel assembly 87, shown most clearly in FIG. 3 of the drawings, engage exterior threads 95 of a lifting tube 97 which tube telescopes inside the worm gear assembly 87 and surrounds the lifting stop rod 75. The upper end of the lifting tube 97 lifts the piston 39.

A threaded nut 99 is locked in engagement with a portion of the lifting tube 97 which extends below the gear housing 81. The nut 99 will engage the bottom of gear housing 81 to limit the vertical upwardly adjustment of the piston 39 by mechanical operation of the worm wheel assembly 87. The nut is held in a selected position of adjustment by a locking pin 101. A lock nut 103 is threaded to the end of the lifting stop rod 75 which extends below the bottom of the lifting tube 97. The lock nut 103 carries a washer 105 which functions as a stop to limit upward movement of the piston 39 relative to the lifting tube 97. Diametrically oppositely located slots 109 formed in the lifting tube 97 receive a pin 111 which extends through the lifting stop rod 75 to prevent rotation of the lifting rod relative to the lifting stop tube 97.

An air entry port 115 is formed in the bottom of the cylinder 29 just above the partition plate 83 and below the piston 39 to provide lifting force for the piston. The port is connected to a source of air under pressure which is not shown in the drawings. Air seals 117 and 119 are installed between the lifting stop rod 75 and the lifting tube 97 and between the partition plate 83 and the lifting tube 97, respectively. A second air port 121 is formed in the cylinder 29 for positive return of the piston 39 to its lowered position. The air port opens into an annular space 123 around the piston 39 to act against an enlarged cap 125 attached to the bottom of the piston 39 by a bolt 127. An air seal 129 is installed on the piston above the air port 121.

In use, the spindle 11 is adjusted manually in the normal manner by rotation of the hand wheel 19 to adjust the polisher motor base plate horizontally. Rotation of the cylinder 29 and its plates 31 and 32 relative to the slidable plate 35 is accomplished by loosening the handle 23, rotating the plates 31 and 32 and relocking the handle 23 after the cylinder has been rotated. Vertical adjustment of the piston 39 is accomplished by rotation of the hand wheel 15 to position the polishing wheel and its driving motor which, although not shown, are mounted on the base plate 51. As is conventional, the hand wheel 15 is rotated until the polishing wheel is in contact with the material to be polished.

The spindle 11 is locked in its vertical position by tightening of the clamp arm 25. When the polishing operation commences, the polishing wheel will be kept in contact with the material to be polished until the polishing wheel begins to wear. To maintain this uniform pressure against the material being polished, air is admitted under pressure through the air port 15 into the cylindrical passage 67 of the cylinder 29 to lift the piston 39. As the polishing material wears, air pressure through the air inlet 115 acting against the cylinder 39 will move the piston upwardly as viewed in FIG. 1 of the drawings to raise the polishing wheel motor base 51. The piston 39 can be moved through a gap of approximately 0.125 inches but this gap can be reduced by adjusting the position of the locking nut 103 relative to the bottom of the lifting tube 97. To return the piston 39 to its lowered position shown in FIG. 1 of the drawings, pressurized air is directed from the air port 115 to the air port 121.

What is claimed is:

1. A pneumatic spindle lifting assembly including:

a support shelf, a piston attached at its non-pressure end to said support shaft, a cylinder receiving said piston for telescopingly sliding movement of said piston relative to said cylinder, a lifting stop rod connected to the pressure end of said piston, an externally threaded tube engaging said pressure end of said piston and telescopingly receiving said lifting stop rod, a worm wheel threadingly engaged with said threaded tube, a worm gear operatively engaged with said worm wheel, a hand wheel connected to said worm gear for rotating said worm gear and said worm wheel, an adjustable connection between said lifting stop rod and said threaded tube to permit limited lifting movement of said lifting stop rod relative to said threaded tube, and a port located in said cylinder for directing pressurized air against said pressure end of said piston to lift said piston and said lifting stop rod relative to said threaded tube.

2. The pneumatic spindle lifting assembly of claim 1 in which said adjustable connection between said lifting stop rod and said threaded tube includes a nut threaded on said lifting stop rod outwardly of the lower end of said externally threaded tube and engageable with the lower end of said tube upon relative movement of said lifting stop rod and said tube.

3. The pneumatic spindle lifting assembly of claim 1 including another port in said cylinder for directing pressurized air against said piston to lower said piston and said lifting stop rod relative to said threaded tube.

* * * * *